US010859939B2

(12) United States Patent
Shintaku et al.

(10) Patent No.: US 10,859,939 B2
(45) Date of Patent: Dec. 8, 2020

(54) IMAGE FORMING APPARATUS

(71) Applicant: FUJI XEROX CO., LTD., Tokyo (JP)

(72) Inventors: Kanji Shintaku, Kanagawa (JP); Hiroki Ando, Kanagawa (JP); Hirofumi Iida, Kanagawa (JP); Keishi Araki, Kanagawa (JP); Satoshi Mizoguchi, Kanagawa (JP); Hiroki Oka, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 16/727,014

(22) Filed: Dec. 26, 2019

(65) Prior Publication Data

US 2020/0326641 A1 Oct. 15, 2020

(30) Foreign Application Priority Data

Apr. 9, 2019 (JP) ..... 2019-074188

(51) Int. Cl.
*G03G 15/02* (2006.01)
*G03G 15/00* (2006.01)

(52) U.S. Cl.
CPC ..... *G03G 15/0266* (2013.01); *G03G 15/0216* (2013.01); *G03G 15/0258* (2013.01); *G03G 15/0275* (2013.01); *G03G 15/5004* (2013.01); *G03G 15/5016* (2013.01); *G03G 2215/025* (2013.01); *G03G 2215/0463* (2013.01)

(58) Field of Classification Search
CPC ..... G03G 15/55; G03G 15/0258; G03G 15/0266; G03G 15/0275; G03G 15/0283; G03G 15/5004; G03G 15/5037
See application file for complete search history.

(56) References Cited

U.S. PATENT DOCUMENTS

2009/0028591 A1* 1/2009 Kubo ..... G03G 15/0266 399/50
2013/0259502 A1 10/2013 Motomura
2015/0110506 A1* 4/2015 Yamaguchi ..... G03G 15/0266 399/31
2019/0163085 A1* 5/2019 Yada ..... G03G 15/0266

FOREIGN PATENT DOCUMENTS

JP 2013-205829 A 10/2013

* cited by examiner

*Primary Examiner* — Thomas S Giampaolo, II
(74) *Attorney, Agent, or Firm* — Sughrue Mion, PLLC

(57) ABSTRACT

An image forming apparatus includes an image carrier that carries an image to be transferred onto a recording medium, a charging member in contact with the image carrier, the charging member that charges the image carrier, an erase unit that erases charge on the image carrier, a current detector that detects a current flowing to the charging member; a forming unit that forms a charged region on a surface of the image carrier, and forms an erased region on the surface of the image carrier using the erase unit, and a state acquisition unit that acquires a deterioration state of the charging member based on (i) a first current flowing in response to applying a voltage from the charging member to the erased region and (ii) a second current flowing in response to applying a voltage from the charging member to the charged region.

17 Claims, 6 Drawing Sheets

| Δ Ic_dif | | DETERIORATION LEVEL | |
|---|---|---|---|
| LARGE | ＊＊＊＊μA～ | SMALL | 0 |
| ↕ | ＊＊＊＊μA～＊＊＊＊μA | ↕ | 2 |
| | ＊＊＊＊μA～＊＊＊＊μA | | 4 |
| | ＊＊＊＊μA～＊＊＊＊μA | | 6 |
| SMALL | ～＊＊＊＊μA | LARGE | 8 |

| Δ Ic_dif | | CORRECTION VALUE Vco | |
|---|---|---|---|
| LARGE | ＊＊＊＊μA～ | SMALL | 0V |
| ↕ | ＊＊＊＊μA～＊＊＊＊μA | ↕ | ＊＊＊V |
| | ＊＊＊＊μA～＊＊＊＊μA | | ＊＊＊V |
| | ＊＊＊＊μA～＊＊＊＊μA | | ＊＊＊V |
| SMALL | ～＊＊＊＊μA | LARGE | ＊＊＊V |

IMAGE FORMING APPARATUS

CROSS-REFERENCE TO RELATED APPLICATIONS

This application is based on and claims priority under 35 USC 119 from Japanese Patent Application No. 2019-074188 filed Apr. 9, 2019.

BACKGROUND

(i) Technical Field

The present disclosure relates to an image forming apparatus.

(ii) Related Art

An image forming apparatus such as a copying machine or a printer using an electrophotographic method has been known. For example, in the image forming apparatus, a surface of an image carrier (a photoconductor drum or the like) that rotates is uniformly charged by a charging member (a charging roller or the like), and the image carrier is exposed to light controlled based on image information to form an electrostatic latent image on the surface of the image carrier. Then, the electrostatic latent image is developed with toner to form a visible image (a toner image), and the toner image is transferred from the image carrier onto a recording medium directly or via an intermediate transfer belt or the like. Then, the recording medium onto which the toner image is transferred is transported to a fixing unit, and the toner image is fixed to the recording medium by the fixing unit. The surface of the image carrier is cleaned by a cleaning member after the transfer, and residual charge is erased by an erase unit.

JP-A-2013-205829 discloses an image forming apparatus using an electrophotographic method. In the image forming apparatus, a charging voltage to be applied to a charging roller is determined in consideration of a transfer voltage to be applied to a transfer roller. The transfer roller is a roller that sandwiches a recording medium with a photoconductor drum while a toner image is transferred onto the recording medium from the photoconductor drum.

SUMMARY

The charging member such as the charging roller may deteriorate due to contamination and the like caused by an external additive contained in the toner. When the charging member deteriorates, the surface of the image carrier may not be charged to an intended potential by the charging member, which may result in a defect in an image formed on the recording medium. There is a demand for an image forming apparatus that allows knowing a deterioration state of the charging member.

Aspects of non-limiting embodiments of the present disclosure relate to allowing knowing a deterioration state of a charging member.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided an image forming apparatus including: an image carrier configured to carry an image to be transferred onto a recording medium; a charging member in contact with the image carrier, the charging member configured to charge the image carrier; an erase unit configured to erase charge on the image carrier; a current detector configured to detect a current that flows to the charging member; a forming unit configured to form a charged region on a surface of the image carrier, and form an erased region on the surface of the image carrier using the erase unit, and a state acquisition unit configured to acquire a deterioration state of the charging member based on (i) a first current that flows in response to applying a voltage from the charging member to the erased region and (ii) a second current that flows in response to applying a voltage from the charging member to the charged region.

BRIEF DESCRIPTION OF THE DRAWINGS

Exemplary embodiment(s) of the present disclosure will be described in detail based on the following figures, wherein.

DETAILED DESCRIPTION

Figure 1:
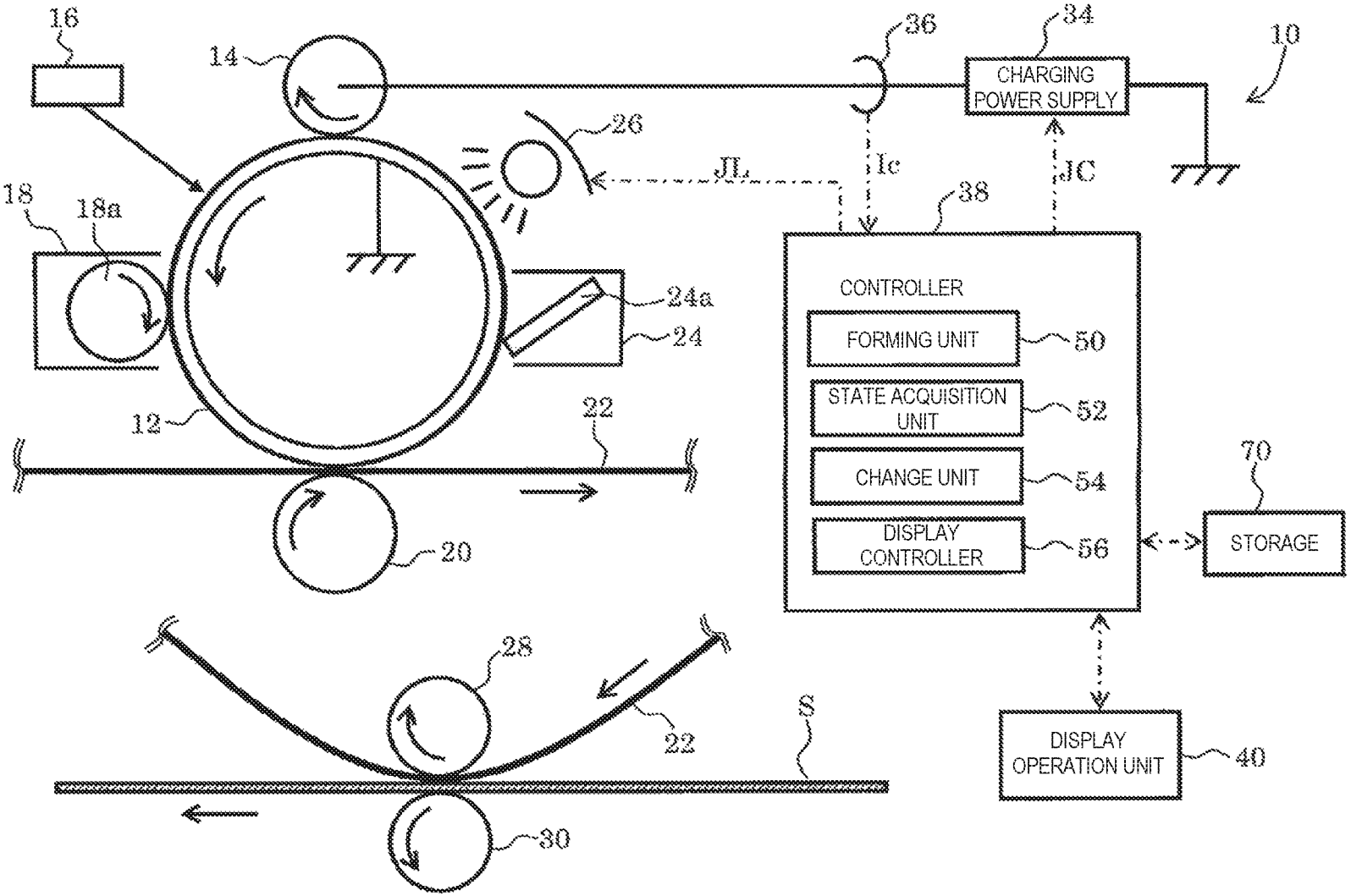
FIG. 1 is a schematic configuration diagram of an image forming apparatus.

Hereinafter, exemplary embodiments of the present disclosure will be described in detail with reference to the accompanying drawings. The configuration described below is merely an example for explanation, and may be appropriately changed in accordance with the specifications of the image forming apparatus and the like. In all the drawings, the same elements are denoted by the same reference numerals, and a repetitive description thereof will be omitted. If the following description contains plural exemplary embodiments and plural modifications, it is to be understood that feature portions of the embodiments and modifications may be used in combination as appropriate.

FIG. 1 is a schematic configuration diagram of an image forming apparatus 10 according to the present exemplary embodiment. The image forming apparatus 10 forms an image on a recording medium S by an electrophotographic method. The image forming apparatus 10 includes a photoconductor drum 12 that rotates, a charging roller 14 that charges a surface of the photoconductor drum 12, an exposure device 16 that forms a latent image on the surface of the photoconductor drum 12, a developing device 18 that develops an electrostatic latent image on the surface of the photoconductor drum 12 to obtain a toner image, a primary transfer roller 20 that transfers the toner image on the photoconductor drum 12 onto an intermediate transfer belt 22, a secondary transfer roller 30 that transfers the toner image on the intermediate transfer belt 22 onto the recording medium S, a cleaning device 24 that removes residual toner and the like on the surface of the photoconductor drum 12, and an erase lamp 26 that erases a residual potential on the surface of the photoconductor drum 12.

The photoconductor drum 12, which is an example of an image carrier, carries an image to be transferred onto the recording medium S via the intermediate transfer belt 22. The photoconductor drum 12 includes a thin metal cylindrical drum and an organic photosensitive layer (not shown) on a surface of the metal cylindrical drum. In the present exemplary embodiment, the organic photosensitive layer is formed of a material to be charged to a negative polarity. An inner peripheral surface (a back surface) of the photoconductor drum 12 is grounded.

The charging roller 14, which is an example of a charging member, is formed of a conductive rubber roller or the like. The charging roller 14 is rotatable while being in contact with the surface of the photoconductor drum 12, and is rotated following the rotation of the photoconductor drum 12. The charging roller 14 is supplied with electric power from a charging power supply 34, applies a charging voltage to the photoconductor drum 12, and charges the photoconductor drum 12 to a negative potential.

The exposure device 16 forms an electrostatic latent image by selectively performing optical writing, using laser light, on the photoconductor drum 12 charged to the negative potential by the charging roller 14. As a light source in the exposure device 16, a light emitting diode (LED) light source or the like may be used in place of a laser light source.

The developing device 18 includes a developing roller 18*a*. The developing roller 18*a* is rotatable and faces the photoconductor drum 12. The developing device 18 houses a developer that contains toner of a predetermined color (for example, black) therein. The developing roller 18*a* carries the developer on a surface thereof and comes in contact with the photoconductor drum 12, thereby developing the electrostatic latent image on the photoconductor drum 12 with the toner.

The primary transfer roller 20 is formed of a conductive rubber roller or the like. The primary transfer roller 20 is rotatable and faces the photoconductor drum 12 via the intermediate transfer belt 22. The primary transfer roller 20 is rotated following travel of the intermediate transfer belt 22. The primary transfer roller 20 applies a primary transfer voltage to the photoconductor drum 12 and the intermediate transfer belt 22 while sandwiching the intermediate transfer belt 22 with the photoconductor drum 12, to primarily transfer the toner image on the photoconductor drum 12 onto the intermediate transfer belt 22.

The secondary transfer roller 30 is formed of a rubber roller or the like. The secondary transfer roller 30 is rotatable. The secondary transfer roller 30 sandwiches the intermediate transfer belt 22 and the recording medium S with a facing roller 28, to secondarily transfer the toner image on the intermediate transfer belt 22 onto the recording medium S. Although not shown, the image forming apparatus 10 includes a fixing device that fixes the toner image secondarily transferred onto the recording medium S by heat, pressure, and the like.

The cleaning device 24 includes a cleaning blade 24*a* that abuts against the surface of the photoconductor drum 12. The cleaning blade 24*a* is formed of, for example, a rubber material such as urethane rubber. The cleaning blade 24 removes materials (such as toner) adhering to the photoconductor drum 12 after the primary transfer.

The erase lamp 26, which is an example of an erase unit, irradiates the surface of the photoconductor drum 12 with erase light to erase the residual potential on the photoconductor drum 12. Examples of the erase lamp 26 include a tungsten lamp. Examples of light quality include white light of the tungsten lamp. LED light or the like may also be used as the erase light. The erase unit may be a device that erases the residual potential on the surface of the photoconductor drum 12 in any manner other than light.

An image forming process of the image forming apparatus 10 will be briefly described below. First, the surface of the photoconductor drum 12 that is rotating is uniformly charged by the charging roller 14. An electrostatic latent image is written on the surface of the charged photoconductor drum 12 by the exposure device 16 such as a laser optical system. The electrostatic latent image on the surface of the photoconductor drum 12 is developed into a toner image by the developing device 18. Then, the toner image is primarily transferred onto the intermediate transfer belt 22. The toner image on the intermediate transfer belt 22 is secondarily transferred, using the secondary transfer roller 30, onto the recording medium S transported from a sheet feeding tray (not shown). The toner image secondarily transferred onto the recording medium S is fixed by the fixing device. Then, the recording medium S is fed out to the outside of the image forming apparatus 10. After the primary transfer, the residual toner on the surface of the photoconductor drum 12 is removed by the cleaning device 24, and the residual potential on the surface of the photoconductor drum 12 is subjected to erase by the erase lamp 26. Thereby, the photoconductor drum 12 is ready for the next image forming process.

As described above, the residual toner on the surface of the photoconductor drum 12 is removed by the cleaning device 24. However, an external additive contained in the toner may slip through the cleaning blade 24*a* of the cleaning device 24 and remain on the surface of the photoconductor drum 12. The remaining external additive may contaminate the surface of the charging roller 14 and causes the charging roller 14 to deteriorate. When the surface of the charging roller 14 is contaminated with the external additive, a resistance value between the charging roller 14 and the photoconductor drum 12 increases. When a charging voltage is applied from the contaminated charging roller 14 to the photoconductor drum 12, the surface of the photoconductor drum 12 may not be charged to a desired potential. That is, the surface of the photoconductor drum 12 is insufficiently charged. Accordingly, a defect occurs in the image carried on the photoconductor drum 12, which leads to a defect in the recording medium S, for example, the toner image is transferred onto an unintended position, or unevenness of the toner image occurs. Therefore, the image forming apparatus 10 of the present exemplary embodiment includes a mechanism that allows knowing deterioration due to the contamination of the charging roller 14. The mechanism will be described in detail below.

The image forming apparatus 10 includes a controller 38, a storage 70, a display operation unit 40, the charging power supply 34 that applies the charging voltage to the charging roller 14, and a current sensor 36 that detects a charging current Ic that flows from the charging power supply 34 to the charging roller 14.

The controller 38 includes, for example, a CPU. The controller 38 reads and executes a program stored in the storage 70 to function as a forming unit 50, a state acquisition unit 52, a change unit 54, and a display controller 56. The forming unit 50, the state acquisition unit 52, the change unit 54, and the display controller 56 in the controller 38 are examples of a forming unit, a state acquisition unit, a change unit, and a display controller, respectively. The storage 70 includes, for example, a flash memory. The storage 70 stores programs to be executed by the controller 38 and various data.

The display operation unit 40 that is an example of a display is, for example, a touch panel. The display operation unit 40 receives a signal from the controller 38 that functions as the display controller 56 and displays a screen in accordance with the received signal. The display controller 40 outputs information that a user inputs to the display operation unit 40 or the like, to the controller 38.

The controller 38 transmits a command JC to the charging power supply 34, and controls the charging voltage that the charging power supply 34 applies to the charging roller 14. The controller 38 transmits a command JL to the erase lamp 26 and controls turning on or off the erase lamp 26. A detection value of the charging current Ic detected by the current sensor 36, which is an example of a current detector, is input to the controller 38.

Here, before description is given on a process of acquiring a deterioration state of the charging roller 14 of the present exemplary embodiment, brief description will be made on transition of a surface potential Vb of the photoconductor drum 12 caused by the charging roller 14, the primary transfer roller 20, and the erase lamp 26. The following description uses specific numerical values. However, it should be noted that these numerical values are given to facilitate understanding, and the present exemplary embodiment is not limited to such numerical values.

First, the charging roller 14 applies a charging voltage Vc to the photoconductor drum 12, thereby charging the surface of the photoconductor drum 12. Here, since the photoconductor drum 12 has a charging start voltage Vsth, the charging voltage Vc applied from the charging roller 14 does not directly become the surface potential Vb of the photoconductor drum 12. For example, it is assumed that the charging start voltage Vsth of the photoconductor drum 12 is about 500 V. When the charging voltage Vc of about −1000 V is applied from the charging roller 14 to the photoconductor drum 12, the surface potential Vb of the photoconductor drum 12 is about −500 V (=500 V−1000 V).

Then, the surface of the photoconductor drum 12 charged by the charging roller 14 travels toward the exposure device 16, passes through the exposure device 16 and the developing device 18, and travels toward the primary transfer roller 20. At this time, the surface potential Vb of the photoconductor drum 12 is slightly changed by the exposure device 16 and the developing device 18. However, for the purpose of simplifying the description, it is assumed that the surface potential Vb of the photoconductor drum 12 after passing through the developing device 18 remains about −500 V.

Then, the surface of the photoconductor drum 12 reaches the primary transfer roller 20. A primary transfer voltage of, for example, +300 V is applied by the primary transfer roller 20, and thus the surface potential Vb of the photoconductor drum 12 is about −200 V (=−500 V+300 V).

Next, the surface of the photoconductor drum 12 passes through the cleaning device 24, reaches the erase lamp 26, and is subjected to the erase by the erase light emitted from the erase lamp 26. Thus, the surface potential Vb of the photoconductor drum 12 is from about −200 V to about 0 V. Then, the surface of the photoconductor drum 12 returns to the charging roller 14 again, and is charged again by the charging roller 14 applying the charging voltage Vc.

In the above description, the surface of the photoconductor drum 12 charged to about −200 V is subjected to the erase by the erase lamp 26. However, in the present exemplary embodiment, in the process of acquiring the deterioration state of the charging roller 14, the controller 38 switches between turning on and turning off the erase lamp 26, thereby changing the surface potential Vb of the surface of the photoconductor drum 12 after passing through the erase lamp 26. That is, an erased region and a charged region are formed on the photoconductor drum 12. The erased region is a surface region of the photoconductor drum 12 where the surface potential Vb of the photoconductor drum 12 is set to about 0 V by turning on the erase lamp 26. The charged region is a surface region of the photoconductor drum 12 where the surface of the photoconductor drum 12 remains charged (about −200 V) by turning off the erase lamp 26.

Figure 2:
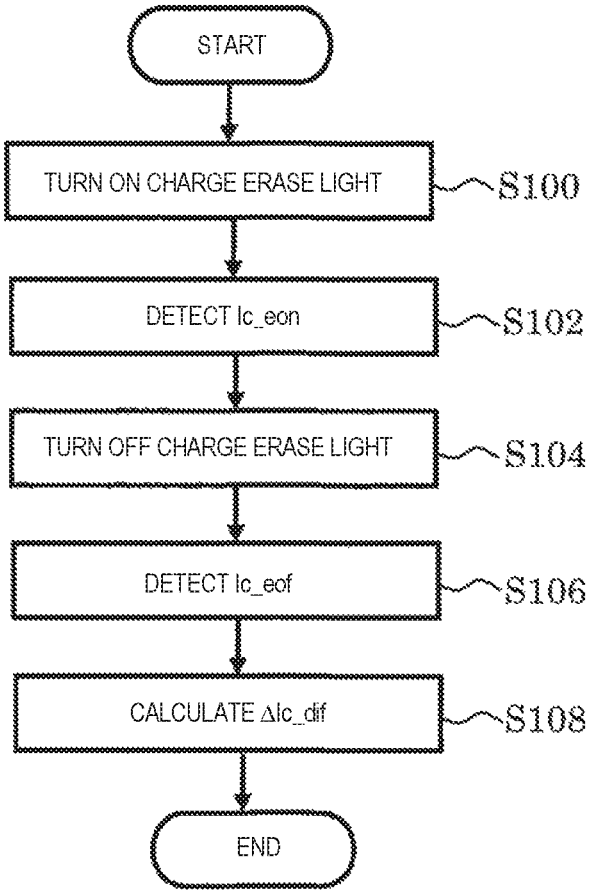
FIG. 2 is a flowchart of a process of acquiring a deterioration state of a charging roller (deterioration acquisition process)

Next, the process of acquiring the deterioration state of the charging roller 14 of the present exemplary embodiment (hereinafter, which may be referred to as a "deterioration acquisition process") will be specifically described. FIG. 2 is a flowchart of the process of acquiring the deterioration state of the charging roller 14. The flow of FIG. 2 is performed, for example, when the power supply of the image forming apparatus 10 is turned on or the image forming apparatus 10 is forming no image on the recording medium S. The flow of FIG. 2 is performed in the following state. That is, the surface potential Vb of the photoconductor drum 12 is set to a constant potential (for example, about −200 V) before the erase lamp 26 by (i) the charging roller 14 applying the predetermined charging voltage Vc (for example, −1000 V) and (ii) the primary transfer roller 20 applying the predetermined primary transfer voltage (for example, +300 V).

First, in S100, the controller 38 functions as the forming unit 50 and transmits the command JL to the erase lamp 26 to turn on the erase lamp 26. When the erase lamp 26 has already been turned on, S100 is skipped. The surface of the photoconductor drum 12 is irradiated with the erase light of the erase lamp 26 to form the erased region (having 0 V in the surface potential Vb) on the photoconductor drum 12.

Next, in step S102, the controller 38 functions as the state acquisition unit 52 and acquires, a charging current Ic_eon (hereinafter, referred to as a "first current Ic_eon") that flows in the charging roller 14, from the current sensor 36 when the charging roller 14 is in contact with the erased region of the photoconductor drum 12. Here, the first current Ic_eon has a magnitude corresponding to about −1000 V (=−1000 V−0 V) that is a potential difference between the charging voltage Vc (−1000 V) that the charging roller 14 applies and the potential (about 0 V) of the erased region of the photoconductor drum 12. Hereinafter, this potential difference will be referred to as a "first potential difference". FIG.

3A is a graph showing a state where the erased region of the photoconductor drum 12 continuously enters the charging roller 14 and the charging current Ic does not change from the first current Ic_eon.

Next, in step S104, the controller 38 functions as the forming unit 50 and transmits the command JL to the erase lamp 26 to turn off the erase lamp 26. Accordingly, the surface of the photoconductor drum 12 is not irradiated with the erase light of the erase lamp 26, and the charged region (having about 200 V in the surface potential Vb) is formed on the photoconductor drum 12.

Next, in step S106, the controller 38 functions as the state acquisition unit 52, and acquires a charging current Ic_eof (hereinafter, referred to as a "second current Ic_eof") that flows in the charging roller 14, from the current sensor 36 when the charging roller 14 is in contact with the charged region of the photoconductor drum 12. Here, the second current Ic_eof has a magnitude corresponding to about −800 V (=−1000 V−(−200 V)) that is a potential difference between the charging voltage Vc (−1000 V) that the charging roller 14 applies and the potential (about −200 V) of the charged region of the photoconductor drum 12. Hereinafter, this potential difference will be referred to as a "second potential difference".

Figure 3A:
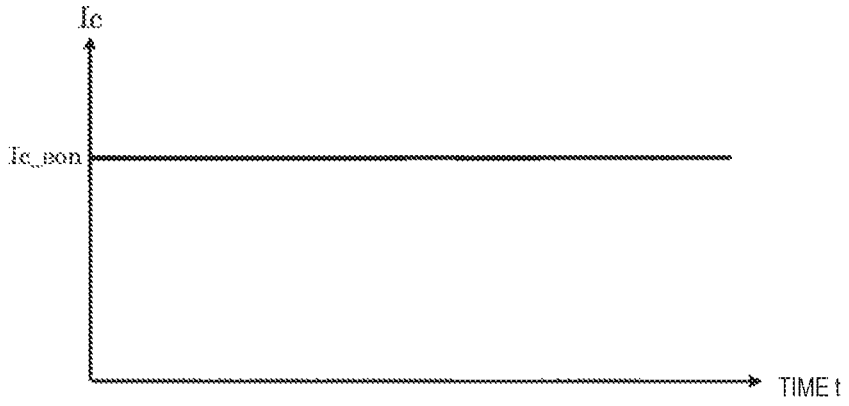
FIG. 3A is a graph showing a charging current flowing when the charging roller is in contact with an erased region.
Figure 3B:
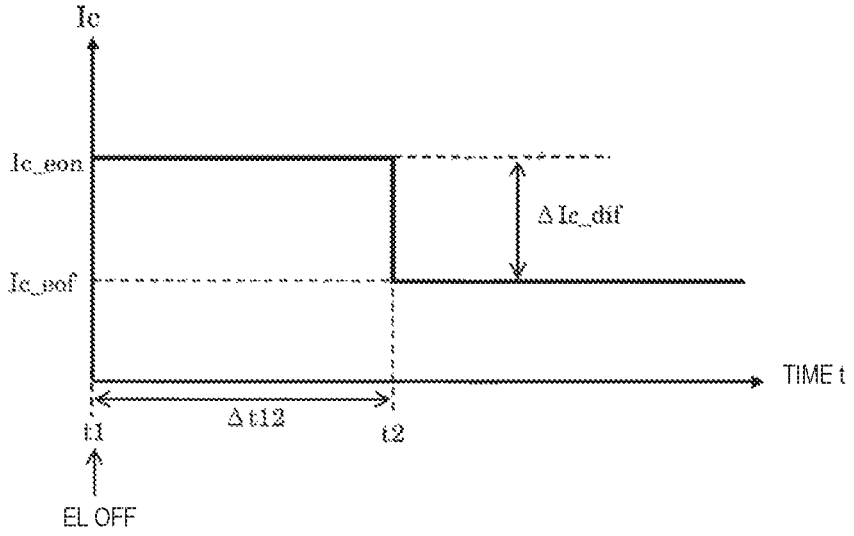
FIG. 3B is a graph showing a charging current flowing when the charging roller is in contact with the erased region and a charged region.

FIG. 3B shows a change in the charging current Ic when the charging roller 14 is in contact with a boundary between the erased region and the charged region. As shown in FIG. 3B, when the erase lamp 26 is turned off at a time point t1 to form the charged region, the charged region of the photoconductor drum 12 enters the charging roller 14 at a time point t2 that is time Δt12 after the time point t1, and the charging current Ic changes from the first current Ic_eon to the second current Ic_eof. Since the second potential difference (about −800 V) corresponding to the second current Ic_eof is smaller than the first potential difference (about −1000 V) corresponding to the first current Ic_eon, the second current Ic_eof is smaller than the first current Ic_eon.

Next, in S108 of FIG. 2, the controller 38 functions as the state acquisition unit 52, and calculates a current difference ΔIc_dif (=Ic_eon−Ic_eof) between the first current Ic_eon and the second current Ic_eof as the deterioration state of the charging roller 14. Accordingly, the process of acquiring the deterioration state of the charging roller 14 is completed.

Figures 4, 5, 6:
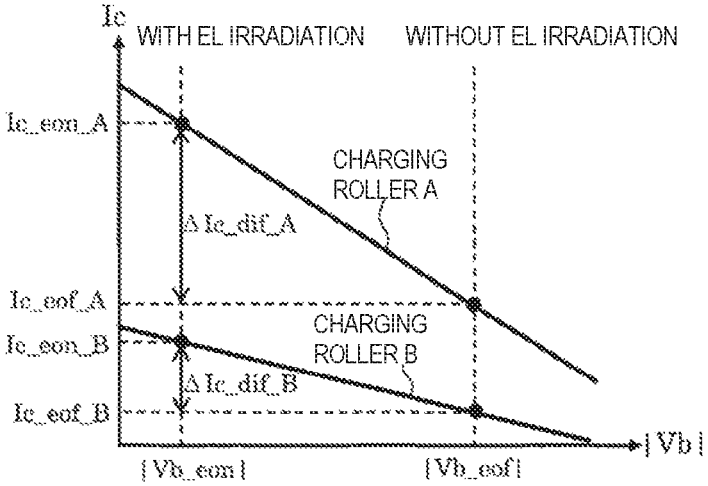
FIG. 4 is a graph showing a difference between a charging roller A having small deterioration and a charging roller B having large deterioration.
FIG. 5 is a table showing an example of association between a current difference ΔIc_dif and a deterioration level.
FIG. 6 is a table showing an example of association between the current difference ΔIc_dif and a correction value Vco.

FIG. 4 is a graph showing examples of a first current Ic_eon_A, a second current Ic_eof_A, and a current difference ΔIc_dif_A that are acquired by performing the deterioration acquisition process in the image forming apparatus 10 including a charging roller having small deterioration (hereinafter, referred to as a "charging roller A"), and examples of a first current Ic_eon_B, a second current Ic_eof_B, and a current difference ΔIc_dif_B that are acquired by performing the deterioration acquisition process in the image forming apparatus 10 including a charging roller having large deterioration (hereinafter, referred to as a "charging roller B"). In FIG. 4, a horizontal axis represents an absolute value Vb of the surface potential Vb of the photoconductor drum 12 that enters the charging roller 14. Vb_eon represents the potential of the erased region of the photoconductor drum 12 (about 0 V). Vb_eof represents the potential of the charged region of the photoconductor drum 12 (about −200 V).

As shown in FIG. 4, the Ic_eon_B and the Ic_eof_B of the charging roller B having the large deterioration are respectively smaller than the Ic_eon_A and the Ic_eof_A of the charging roller A having the small deterioration. This is because, when the surface of the charging roller 14 is contaminated by the external additive and deteriorates, the resistance value between the charging roller 14 and the surface of the photoconductor drum 12 increases, and the charging current Ic that flows to the charging roller 14 decreases. Therefore, by simply detecting the charging current Ic, the deterioration of the charging roller 14 may be known. However, it is difficult to accurately know a deterioration degree of the charging roller 14.

On the other hand, ΔIc_dif_B of the charging roller B having the large deterioration is also smaller than ΔIc_dif_A of the charging roller A having the small deterioration. This is because, when the surface of the charging roller 14 is contaminated by the external additive and deteriorates, the charging current Ic does not follow a potential change when a change portion (the boundary between the erased region and the charged region) of the surface potential Vb of the photoconductor drum 12 enters the charging roller 14. Compared with the charging current Ic, the current difference ΔIc_dif represents the deterioration degree of the charging roller 14 with high accuracy. Therefore, in the present exemplary embodiment, the current difference ΔIc_dif is acquired as the deterioration state of the charging roller 14. The smaller the value of the current difference ΔIc_dif is, the more the charging roller 14 deteriorates.

The image forming apparatus 10 of the present exemplary embodiment allows knowing the deterioration state of the charging roller 14. When the charging roller 14, which is disposed downstream of the erase lamp 26 in the rotation direction of the photoconductor drum 12, applies the charging voltage Vc near the boundary between the erased region and the charged region that are formed by switching the erase lamp 26 from on to off, the first current Ic_eon and the second current Ic_eof are acquired in a zone that is a part of the photoconductor drum 12 in a circumferential direction. Thus, the deterioration state (current difference ΔIc_dif) of the charging roller 14 is acquired.

In the exemplary embodiment described above, the current difference ΔIc_dif is calculated from the first current Ic_eon and the second current Ic_eof. Alternatively, for example, a table may be used. The table is stored in the storage 70 in advance. In the table, the first current Ic_eon and the second current Ic_eof are associated with the deterioration state (for example, a deterioration level) of the charging roller. The deterioration state of the charging roller may be acquired based on the first current Ic_eon, the second current Ic_eof, and the table. Calculating the current difference ΔIc_dif as in the exemplary embodiment more easily acquires the deterioration state of the charging roller 14.

In the exemplary embodiment described above, first, the first current Ic_eon is acquired by turning on the erase lamp 26 to form the erased region on the photoconductor drum 12, and then the second current Ic_eof is acquired by turning off the erase lamp 26 to form the charged region on the photoconductor drum 12. Alternatively, first, the second current Ic_eof may be acquired by turning off the erase lamp 26 to form the charged region on the photoconductor drum 12, and then the first current Ic_eon may be acquired by turning on the erase lamp 26 to form the erased region on the photoconductor drum 12.

Execution of the process of acquiring the deterioration state of the charging roller 14 of the exemplary embodiment forms the potential step at the boundary between the erased region and the charged region on the photoconductor drum 12. Such a potential step is eliminated as time elapses. However, when an image forming operation on the recording medium S is started immediately after the process of acquiring the deterioration state of the charging roller 14, a defect may occur in an image to be transferred onto the recording medium S. Therefore, when a time period from a time when the erased region and the charged region are formed on the surface of the photoconductor drum 12 to a time when the image forming operation is started is shorter than a predetermined time period, the surface of the photoconductor drum 12 may be subjected to the erase by the erase lamp 26. Accordingly, the potential step on the photoconductor drum 12 is accurately eliminated before the image forming operation is started.

The current difference ΔIc_dif acquired by the process of acquiring the deterioration state of the charging roller 14 of the exemplary embodiment may be converted into the deterioration level or a rank. For example, as shown in FIG. 5, a table in which the current difference ΔIc_dif is associated with the deterioration level is stored in the storage 70 in advance. The deterioration level is acquired based on the current difference ΔIc_dif and the table. Such a deterioration level may be used for display of a deterioration level on the display operation unit 40 which will be described later (see FIG. 8) or the like.

Next, a process of correcting the charging voltage Vc that the charging roller 14 applies to the photoconductor drum 12 (hereinafter, which may be referred to as a "voltage correction process") will be described. As described above, when the charging roller 14 is contaminated and deteriorates, the surface of the photoconductor drum 12 may not be charged to a desired potential by the charging roller 14. Therefore, the voltage correction process is performed to correct (change) the charging voltage Vc applied from the charging roller 14 to the photoconductor drum 12 such that the surface of the photoconductor drum 12 can be charged to the desired potential.

Figure 7:
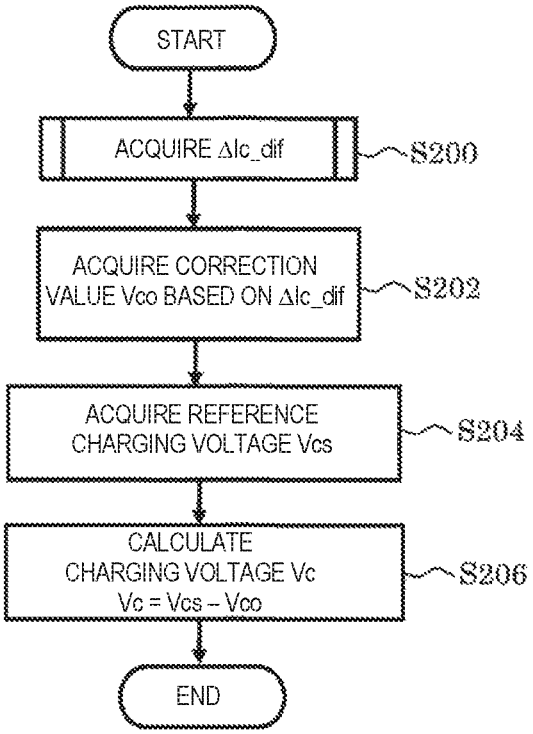
FIG. 7 is a flowchart of a process of correcting a voltage that the charging roller applies to a photoconductor drum (voltage correction process)

FIG. 7 is a flowchart of the process of correcting the voltage that the charging roller 14 applies to the photoconductor drum 12 (that is, the voltage correction process). First, in S200, the controller 38 performs the process of acquiring the deterioration state of the charging roller 14 shown in FIG. 2 to acquire the current difference ΔIc_dif.

Next, in S202, the controller 38 functions as the change unit 54 and acquires a correction value Vco based on the current difference ΔIc_dif. FIG. 6 shows an example of a table in which the current difference ΔIc_dif and the correction value Vco are associated with each other. In the table, the current difference ΔIc_dif and the correction value Vco are associated with each other in such a manner that the smaller the current difference ΔIc_dif is (the more the deterioration of the charging roller 14 is), the larger the correction value Vco is. The correction value Vco of 0 is associated with the current differences ΔIc_dif that are larger than a predetermined value (such current differences ΔIc_dif indicate no deterioration of the charging roller 14 or small deterioration of the charging roller 14). For example, the table is stored in the storage 70 in advance. The change unit 54 acquires, from the table, the correction value Vco corresponding to the current difference ΔIc_dif acquired in S200. The change unit 54 may perform predetermined calculation using the current difference ΔIc_dif, to acquire the correction value Vco.

Next, in S204 of FIG. 7, the change unit 54 acquires a reference charging voltage Vcs. The reference charging voltage Vcs is the charging voltage Vc of the charging roller 14 before the correction. For example, the reference charging voltage Vcs is stored in the storage 70 in advance. Here, it is assumed that the reference charging voltage Vcs is a negative value.

Next, in S206, the change unit 54 adds the correction value Vco to the reference charging voltage Vcs to obtain the charging voltage Vc. As described above, the charging voltage Vc is the negative value, and the correction value Vco is defined as a positive value in the table of FIG. 6. Thus, −Vco that is acquired by converting the correction value Vco into a negative value is added to the reference charging voltage Vcs to acquire the charging voltage Vc in S206 of FIG. 7.

Then, the change unit 54 transmits the command JC to the charging power supply 34 shown in FIG. 1 to change the charging voltage that the charging power supply 34 applies to the charging roller 14 (that is, the charging voltage that the charging roller 14 applies to the photoconductor drum 12), from the reference charging voltage Vcs to the corrected charging voltage Vc. The above is the process of correcting the voltage that the charging roller 14 applies (that is, the voltage correction process).

According to the process of correcting the voltage that the charging roller 14 applies (that is, the voltage correction process), the smaller the current difference ΔIc_dif is (the larger the deterioration of the charging roller 14 is), the higher the charging voltage Vc applied from the charging roller 14 to the photoconductor drum 12 is. Therefore, even when the deterioration of the charging roller 14 is large, the surface of the photoconductor drum 12 is charged to the desired potential. That is, optimized is the charging voltage Vc applied from the charging roller 14 to the photoconductor drum 12 in forming an image on the recording medium S. Accordingly, an image defect in the recording medium S is prevented.

Figure 8:
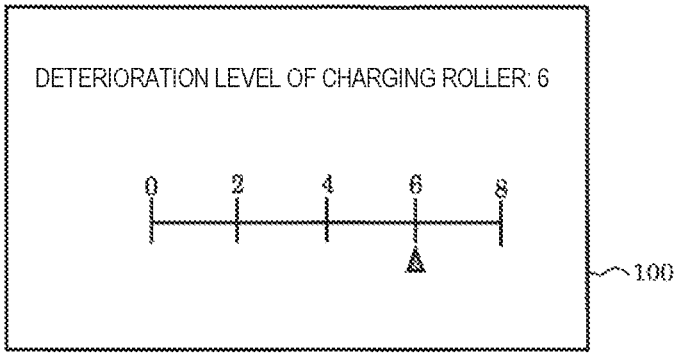
FIG. 8 is a diagram showing an example of a display screen displaying the deterioration level of the charging roller.

Next, an example in which the deterioration state of the charging roller 14 is displayed on the display operation unit 40 will be described. For example, the deterioration level corresponding to the current difference ΔIc_dif may be acquired using the table (that is stored in the storage 70 in advance) shown in FIG. 5 in which the current difference ΔIc_dif and the deterioration level are associated with each other, and the deterioration level may be displayed on a screen of the display operation unit 40. FIG. 8 shows an example of a display screen 100 in this case. Accordingly, the user, a serviceman, or the like knows the deterioration state of the charging roller 14. It should be noted that the display screen 100 of FIG. 8 is mere an example, and the deterioration state of the charging roller 14 may be displayed in various modes. For example, the deterioration level of the charging roller 14 may be displayed together with a state (such as the deterioration state or a wear state) of another member.

Figure 9:
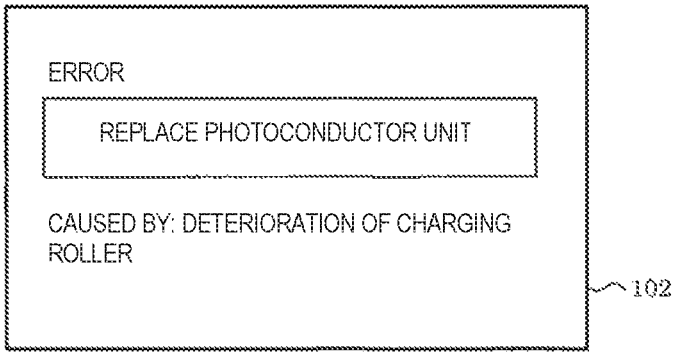
FIG. 9 is a diagram showing an example of a display screen displaying a warning in response to deterioration of the charging roller.

When the current difference ΔIc_dif is smaller than a predetermined value, a warning (an error display or the like) may be displayed on the screen of the display operation unit 40. FIG. 9 shows an example of a display screen 102 in this case. Accordingly, the user, the serviceman, or the like knows that the charging roller 14 has deteriorated very much. FIG. 9 displays a message that prompts the user, the serviceman, or the like to replace a photoconductor unit (a unit including the photoconductor drum 12, the charging roller 14 and the like). It should be noted that such a message is not essential but may be displayed as necessary. The display screen 102 of FIG. 9 is mere an example, and the deterioration state of the charging roller 14 may be displayed in various modes.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image carrier configured to carry an image to be transferred onto a recording medium;

a charging member in contact with the image carrier, the charging member configured to charge the image carrier;

an erase unit configured to erase charge on the image carrier;

a current detector configured to detect a current that flows to the charging member;

a forming unit configured to form a charged region on a surface of the image carrier, and form an erased region on the surface of the image carrier using the erase unit; and a state acquisition unit configured to acquire a deterioration state of the charging member based on (i) a first current that flows in response to applying a voltage from the charging member to the erased region and (ii) a second current that flows in response to applying a voltage from the charging member to the charged region.

2. The image forming apparatus according to claim 1, wherein the image carrier is configured to rotate, the erase unit is disposed upstream of the charging member in a direction in which the image carrier rotates, and the forming unit is configured to form the charged region and the erased region on the surface of the image carrier by charging the image carrier using the charging member and then switching between turning on and turning off of the erase unit.

3. The image forming apparatus according to claim 2, wherein the state acquisition unit is configured to acquire a current difference between the first current and the second current as the deterioration state of the charging member.

4. The image forming apparatus according to claim 2, further comprising:

a change unit configured to change a voltage to be applied from the charging member to the image carrier during image formation, based on the deterioration state of the charging member.

5. The image forming apparatus according to claim 2, further comprising:

a display configured to display a deterioration level of the charging member based on the deterioration state of the charging member.

6. The image forming apparatus according to claim 2, wherein when a time after the forming unit forms the charged region and the erased region on the surface of the image carrier until an image forming operation is started is shorter than a predetermined time, the erase unit erases the charge from the surface of the image carrier.

7. The image forming apparatus according to claim 1, wherein the state acquisition unit is configured to acquire a current difference between the first current and the second current as the deterioration state of the charging member.

8. The image forming apparatus according to claim 7, further comprising:

a change unit configured to change a voltage to be applied from the charging member to the image carrier during image formation, based on the current difference.

9. The image forming apparatus according to claim 8, wherein the change unit is configured to change the voltage such that the smaller the current difference is, the higher the voltage to be applied from the charging member to the image carrier during the image formation is.

10. The image forming apparatus according to claim 7, further comprising:

a display configured to display a deterioration level of the charging member based on the current difference.

11. The image forming apparatus according to claim 10, wherein as the current difference decreases, the display displays the deterioration level indicating that the charging member more deteriorates.

12. The image forming apparatus according to claim 7, further comprising:

a display configured to display a warning when the current difference is smaller than a predetermined value.

13. The image forming apparatus according to claim 1, further comprising:

a change unit configured to change a voltage to be applied from the charging member to the image carrier during image formation, based on the deterioration state of the charging member.

14. The image forming apparatus according to claim 1, further comprising:

a display configured to display a deterioration level of the charging member based on the deterioration state of the charging member.

15. The image forming apparatus according to claim 1, wherein when a time after the forming unit forms the charged region and the erased region on the surface of the image carrier until an image forming operation is started is shorter than a predetermined time, the erase unit erases the charge from the surface of the image carrier.

16. An image forming apparatus comprising:

an image carrier configured to carry an image to be transferred onto a recording medium;

a charging member in contact with the image carrier, the charging member configured to charge the image carrier;

an erase unit configured to erase charge on the image carrier;

a current detector configured to detect a current that flows to the charging member;

a forming unit configured to form a charged region on a surface of the image carrier, and form an erased region on the surface of the image carrier using the erase unit; and a change unit configured to change a voltage applied from the charging member to the image carrier during image formation based on (i) a first current that flows in response to applying a voltage from the charging member to the erased region and (ii) a second current that flows in response to applying a voltage from the charging member to the charged region.

17. An image forming apparatus comprising:

image carrying means for carrying an image to be transferred onto a recording medium;

charging means in contact with the image carrying means, the charging means for charging the image carrier;

erase means for erasing charge on the image carrying means;

current detecting means for detecting a current that flows to the charging means;

forming means for forming a charged region on a surface of the image carrying means, and forming an erased region on the surface of the image carrying means using the erase means; and state acquisition means for acquiring a deterioration state of the charging means based on (i) a first current that flows in response to applying a voltage from the charging means to the erased region and (ii) a second current that flows in response to applying a voltage from the charging means to the charged region.

* * * * *